US008448815B2

(12) United States Patent
Sholl et al.

(10) Patent No.: US 8,448,815 B2
(45) Date of Patent: May 28, 2013

(54) PRODUCT DISPENSER WITH LOW PRODUCT INDICATOR

(75) Inventors: Andrew B. Sholl, Cranbury, NJ (US); John Gelardi, Midlothian, VA (US); Aaron L. Bates, Moseley, VA (US); Laurel Thomas, Richmond, VA (US); Caleb S. Loftin, Richmond, VA (US)

(73) Assignee: MeadWestvaco Corporation, Richmond, VA (US)

( * ) Notice: Subject to any disclaimer, the term of this patent is extended or adjusted under 35 U.S.C. 154(b) by 271 days.

(21) Appl. No.: 12/890,637

(22) Filed: Sep. 25, 2010

(65) Prior Publication Data

US 2011/0121022 A1 May 26, 2011

Related U.S. Application Data

(63) Continuation-in-part of application No. 12/777,444, filed on May 11, 2010, now Pat. No. 7,922,437.

(60) Provisional application No. 61/263,767, filed on Nov. 23, 2009.

(51) Int. Cl.
*G07F 11/00* (2006.01)

(52) U.S. Cl.
USPC ..... 221/6; 221/15

(58) Field of Classification Search
USPC ..... 221/6, 17
See application file for complete search history.

(56) References Cited

U.S. PATENT DOCUMENTS

| | | | |
|---|---|---|---|
| 902,347 | A | 10/1908 | Tillinghast |
| 1,291,420 | A | 1/1919 | Cough |
| 1,383,318 | A | 7/1921 | McCormick |
| 1,393,964 | A | 10/1921 | Potts et al. |
| 1,753,957 | A | 4/1930 | Washburn |
| 1,824,937 | A | 9/1931 | Trouth |
| 1,858,199 | A | 10/1932 | Maziroff |
| 1,898,056 | A | 2/1933 | Johnson |
| 1,919,907 | A | 7/1933 | Robinson |
| 1,932,225 | A | 10/1933 | Minter |
| 1,941,458 | A | 2/1934 | Bens |
| 1,985,739 | A | 12/1934 | Murray |
| 2,078,599 | A | 4/1937 | McCauley |
| 2,110,194 | A | 3/1938 | Blier |
| 2,263,353 | A | 11/1941 | Eidam |

(Continued)

FOREIGN PATENT DOCUMENTS

| | | |
|---|---|---|
| AT | 6036 U1 | 3/2003 |
| DE | 2655496 | 6/1978 |

(Continued)

OTHER PUBLICATIONS

International Search Report and Written Opinion issued in PCT/US2010/057020 (Mar. 8, 2011).

(Continued)

*Primary Examiner* — Timothy Waggoner
(74) *Attorney, Agent, or Firm* — Walters & Wasylyna LLC

(57) ABSTRACT

A product dispenser including a frame configured to support a plurality of products and flag element connected to the frame, the flag element being moveable relative to the frame from a first, un-deployed configuration when the flag element is engaged with at least one of the products, to a second, deployed configuration when the flag element is not engaged with the products.

20 Claims, 5 Drawing Sheets

U.S. PATENT DOCUMENTS 2,291,187 A 7/1942 Johnson
2,382,191 A 7/1944 Weichselbaum
2,536,421 A 2/1951 Burhans
2,573,381 A 10/1951 Arnold
2,574,087 A 11/1951 Burhans
2,595,122 A 4/1952 Burhans
2,732,619 A 1/1956 Labine
2,784,871 A 3/1957 Gabrielsen
2,795,845 A 6/1957 Shimer
2,818,978 A 1/1958 Post
2,826,471 A 3/1958 Fonda
2,831,591 A 4/1958 Morton
2,888,145 A 5/1959 Knott et al.
2,915,162 A 12/1959 Umstead
2,915,932 A 12/1959 Gross
2,919,488 A 1/1960 Brownlee
2,996,344 A 8/1961 Garman
3,018,149 A 1/1962 Parker
3,055,293 A 9/1962 Lariccia
3,066,827 A 12/1962 Pryor
3,137,068 A 6/1964 Quigley
D198,888 S 8/1964 Heselov
3,178,242 A 4/1965 Ellis et al.
3,184,104 A 5/1965 De Domenico et al.
3,203,554 A 8/1965 Pendergrast et al.
3,204,335 A 9/1965 Hughes
3,288,544 A 11/1966 Knecht
3,300,115 A 1/1967 Schauer
3,304,141 A 2/1967 Rogers
3,306,688 A 2/1967 Di Domenico
3,318,455 A 5/1967 Takahashi
3,335,940 A 8/1967 Dykes
3,340,790 A 9/1967 Simjian
3,348,738 A 10/1967 Hertlein
3,392,901 A 7/1968 Krzyzanowski
3,393,808 A 7/1968 Chirchill
3,501,016 A 3/1970 Eaton
3,763,557 A 10/1973 Sewell
3,784,022 A 1/1974 Beesley, Jr.
3,922,778 A 12/1975 Aalpoel
3,923,159 A 12/1975 Taylor et al.
3,972,454 A 8/1976 Croley
4,105,126 A 8/1978 Deffner et al.
4,205,440 A 6/1980 Morgan
4,260,072 A 4/1981 Quasarano
4,318,458 A 3/1982 Ritsema
4,382,526 A 5/1983 Stone
4,396,143 A 8/1983 Killy
4,435,026 A 3/1984 Johnson
4,467,524 A 8/1984 Ruff et al.
4,576,272 A 3/1986 Morgan, Jr.
4,598,828 A 7/1986 Young et al.
4,729,480 A 3/1988 Groover et al.
4,742,936 A * 5/1988 Rein ..... 221/5
4,744,489 A * 5/1988 Binder et al. ..... 221/6
4,834,263 A 5/1989 Becze
4,869,395 A 9/1989 Rubbmark
4,911,309 A 3/1990 Stefan
4,915,571 A 4/1990 Toshihiko et al.
4,923,070 A 5/1990 Jackle et al.
4,997,106 A 3/1991 Rockola
4,998,628 A 3/1991 Ross
5,033,348 A 7/1991 Walsh
5,080,256 A 1/1992 Rockola
5,101,703 A 4/1992 Tanaka et al.
5,167,345 A 12/1992 Bleeker
5,190,155 A 3/1993 Grunwald
5,251,972 A 10/1993 Zurawin
5,289,943 A 3/1994 Powell
5,314,078 A 5/1994 Morikiyo et al.
5,328,258 A 7/1994 Scalise
5,356,033 A 10/1994 Delaney
5,372,278 A 12/1994 Leight
5,390,821 A 2/1995 Markel
5,396,997 A 3/1995 Johnson
D363,174 S 10/1995 Fletcher, Sr.
5,462,198 A 10/1995 Schwimmer
5,529,207 A 6/1996 Oden et al.
5,638,988 A 6/1997 Rogers
5,685,664 A 11/1997 Parham et al.
5,740,610 A 4/1998 Ayer et al.
5,788,117 A 8/1998 Zimmanck
5,791,048 A 8/1998 Bodnar et al.
5,836,478 A 11/1998 Weiss
5,878,862 A 3/1999 Dewsnap
5,881,910 A * 3/1999 Rein ..... 221/6
5,894,942 A 4/1999 Miyashita et al.
5,924,573 A 7/1999 Piraneo et al.
5,992,286 A 11/1999 Boole
5,992,652 A * 11/1999 Springs ..... 211/59.3
6,186,345 B1 2/2001 Robertson
6,199,720 B1 3/2001 Rudick et al.
6,206,237 B1 3/2001 Dillon et al.
6,253,930 B1 7/2001 Freidus et al.
6,267,258 B1 7/2001 Wilkerson et al.
6,393,799 B2 5/2002 Jenkins et al.
6,453,641 B1 9/2002 Puckett
6,517,025 B1 * 2/2003 Budz ..... 242/563
6,637,604 B1 10/2003 Jay
6,802,433 B2 10/2004 Leykin
6,991,116 B2 1/2006 Johnson et al.
7,207,447 B2 4/2007 Medcalf et al.
7,303,095 B2 12/2007 Nagelski et al.
7,546,973 B2 6/2009 Budz et al.
7,584,854 B2 9/2009 Chandaria
7,614,543 B1 11/2009 Miller
D604,972 S 12/2009 Henry et al.
7,665,618 B2 2/2010 Jay et al.
7,681,745 B2 3/2010 Richter
7,690,518 B2 4/2010 Fincher et al.
7,757,890 B2 7/2010 Alford et al.
7,810,672 B1 10/2010 Mason et al.
7,823,733 B2 11/2010 Futori
7,841,479 B2 11/2010 Budge et al.
7,850,015 B1 12/2010 Mason
7,913,860 B2 3/2011 Merl
7,918,365 B2 4/2011 White et al.
7,922,437 B1 4/2011 Loftin et al.
7,992,747 B2 8/2011 Bauer
8,028,855 B2 10/2011 White et al.
8,047,400 B1 11/2011 Luberto et al.
8,302,809 B1 11/2012 Bogdziewicz et al.
8,308,023 B2 11/2012 Gelardi et al.
2002/0043509 A1 4/2002 Lajeunesse et al.
2003/0173322 A1 9/2003 Rushing
2004/0011751 A1 1/2004 Johnson et al.
2004/0079760 A1 4/2004 Rink
2004/0262326 A1 12/2004 Christensen
2005/0092644 A1 5/2005 Cafferata et al.
2005/0127015 A1 6/2005 Medcalf et al.
2005/0207877 A1 9/2005 Haverdink et al.
2006/0081692 A1 4/2006 Stewart et al.
2006/0237384 A1 10/2006 Neumann et al.
2006/0243683 A1 11/2006 Onachilla et al.
2006/0278591 A1 12/2006 Tippets et al.
2007/0194037 A1 8/2007 Close
2008/0245813 A1 10/2008 Johnson et al.
2009/0212066 A1 8/2009 Bauer
2009/0266776 A1 10/2009 Johnson
2009/0277853 A1 11/2009 Bauer
2009/0308885 A1 12/2009 Sainato et al.
2010/0032391 A1 2/2010 Schneider et al.
2010/0096401 A1 4/2010 Sainato et al.
2011/0121010 A1 5/2011 Loftin et al.
2011/0121011 A1 5/2011 Gelardi et al.
2011/0121022 A1 5/2011 Sholl et al.
2012/0018391 A1 1/2012 Gelardi et al.
2012/0074016 A1 3/2012 Gelardi et al.
2012/0074164 A1 3/2012 Walling et al.
2012/0074190 A1 3/2012 Fisher et al.
2012/0080513 A1 4/2012 Thomas et al.
2012/0097694 A1 4/2012 Gelardi
2012/0152970 A1 6/2012 Thomas
2012/0211522 A1 8/2012 Gelardi et al.
2012/0217213 A1 8/2012 Thomas
2012/0217261 A1 8/2012 Bailey et al.
2012/0223090 A1 9/2012 Thomas et al.

| | | | |
|---|---|---|---|
| 2012/0279893 | A1 | 11/2012 | Gelardi et al. |
| 2012/0285976 | A1 | 11/2012 | Bogdziewicz et al. |
| 2012/0285977 | A1 | 11/2012 | Bates et al. |

FOREIGN PATENT DOCUMENTS

| | | | |
|---|---|---|---|
| DE | 29808673 | | 11/1998 |
| DE | 19808162 | | 9/1999 |
| DE | 20111307 | | 10/2001 |
| DE | 202007012114 | | 11/2007 |
| FR | 2415051 | | 8/1979 |
| GB | 1283210 | | 7/1972 |
| GB | 2190906 | | 12/1987 |
| GB | 2303624 | | 2/1997 |
| JP | 03105494 | A | 5/1991 |
| JP | 03133737 | A | 6/1991 |
| JP | 03198192 | A | 8/1991 |
| JP | 03273469 | A | 12/1991 |
| JP | 03273470 | A | 12/1991 |
| JP | 03273471 | A | 12/1991 |
| JP | 03273472 | A | 12/1991 |
| JP | 03273474 | | 12/1991 |
| JP | 03273476 | A | 12/1991 |
| JP | 03273477 | A | 12/1991 |
| JP | 03273480 | A | 12/1991 |
| JP | 03273482 | A | 12/1991 |
| JP | 03273483 | A | 12/1991 |
| JP | 04086985 | A | 3/1992 |
| JP | 04115392 | A | 4/1992 |
| JP | 04137194 | A | 5/1992 |
| JP | 05004640 | A | 1/1993 |
| JP | 05174239 | A | 7/1993 |
| JP | 05346984 | A | 12/1993 |
| JP | 08161611 | A | 6/1996 |
| JP | 09027066 | A | 1/1997 |
| JP | 09102065 | A | 4/1997 |
| JP | 09282537 | A | 10/1997 |
| JP | 09311971 | A | 12/1997 |
| JP | 10269421 | A | 10/1998 |
| JP | 11011471 | A | 1/1999 |
| JP | 11171264 | A | 6/1999 |
| JP | 11191175 | A | 7/1999 |
| JP | 11328513 | A | 11/1999 |
| JP | 2001072076 | A | 3/2001 |
| JP | 2001206358 | A | 7/2001 |
| JP | 2003327243 | A | 11/2003 |
| JP | 2004017970 | A | 1/2004 |
| JP | 2005338910 | A | 12/2005 |
| JP | 04157593 | B1 | 10/2008 |
| WO | WO-9106076 | A1 | 5/1991 |
| WO | WO 9321074 | | 10/1993 |
| WO | WO 9423619 | | 10/1994 |
| WO | WO 0054632 | | 9/2000 |
| WO | WO 2004014755 | | 2/2004 |
| WO | WO 2004113808 | | 12/2004 |
| WO | WO 2009138538 | | 11/2009 |
| WO | WO 2011025483 | | 3/2011 |
| WO | WO 2011030320 | | 3/2011 |
| WO | WO 2011109350 | | 9/2011 |

OTHER PUBLICATIONS

International Search Report and Written Opinion issued in PCT/US2010/057221 (Mar. 4, 2011).

* cited by examiner

PRODUCT DISPENSER WITH LOW PRODUCT INDICATOR

PRIORITY

This application is a continuation-in-part of U.S. patent application Ser. No. 12/777,444 filed on May 11, 2010 (pending), the entire contents of which are incorporated herein by reference, which claims priority from U.S. Provisional Patent Application No. 61/263,767 filed on Nov. 23, 2009 (pending), the entire contents of which are incorporated herein by reference.

FIELD

This application relates to apparatus and systems for dispensing products and, more particularly, to product dispensing apparatus and systems configured to provide an indication when product level is low.

BACKGROUND

Products are typically shipped to retailers in bulk by enclosing multiple individual product units in a container, such as a carton or box. For example, canned foods may be shipped to a retailer in a box containing twenty-four individual cans. Then, it is typically the retailer's obligation to remove the individual product units from the container and present them (e.g., on a shelf) to consumers.

Alternatives to the traditional package-ship-unpack-display model are being developed in an effort to improve operating efficiency. For example, U.S. patent application Ser. No. 12/777,444 discloses a new system for dispensing and displaying products packaged in a container. Specifically, the system includes a frame having a support structure, a product display area and an opening tool. The frame may be positioned on a retailer's shelf and loaded with product simply by placing a container comprising multiple units of product onto the support structure of the frame. As the container is being placed onto the support structure, the opening tool of the frame opens the container in such a manner that product rolls from the container and down to the product display area of the frame under the force of gravity.

Unfortunately, it is often difficult to determine when the container is empty and a new container should be loaded onto the frame. Failure to maintain the frame of the dispenser stocked with product may result in customer dissatisfaction and lost sales.

Accordingly, those skilled in the art continue with research and development efforts directed to apparatus and systems for dispensing products.

SUMMARY

In one aspect, the disclosed product dispenser with low product indicator may include a frame configured to support a plurality of products and a flag element connected to the frame, the flag element being moveable relative to the frame from a first, un-deployed configuration when the flag element is engaged with at least one of the products, to a second, deployed configuration when the flag element is not engaged with the products.

In another aspect, the disclosed product dispenser with low product indicator may include a frame configured to support a plurality of products and a flag element connected to the frame, the flag element being moveable relative to the frame from a first, un-deployed configuration when the flag element is engaged with at least one of the products, to a second, deployed configuration when the flag element is not engaged with the products, wherein the flag element includes a front face, and wherein the front face is optionally, marked with various text, graphics and colors to indicate a low product condition.

In another aspect, the disclosed product dispenser with low product indicator may include a frame having a first side wall, a second side wall laterally spaced from the first side wall and an upper support surface extending between the first and second side walls, the upper support surface including a front end and a rear end, the front end defining an aperture therein, and a flag element pivotally connected to the frame, the flag element including a front end and a rear end, wherein the flag element is moveable from a first configuration, wherein the front end of the flag element is aligned with the aperture, to a second configuration, wherein the front end of the flag element is displaced from the aperture.

In yet another aspect, the disclosed product dispenser with low product indicator may include a frame having a support surface having longitudinally spaced front end and rear ends, a plurality of products positioned on the support surface, wherein the support surface is configured to urge the products to the front end of the support surface, and a flag element connected to the frame and moveable relative to the frame between a first configuration and a second configuration, wherein the flag element is in the first configuration when the flag element is engaged with at least one of the products, and wherein the flag element is in the second configuration when the flag element is not engaged with the products.

Other aspects of the disclosed product dispenser with low product indicator will become apparent from the following detailed description, the accompanying drawings and the appended claims.

DETAILED DESCRIPTION

Figure 1:
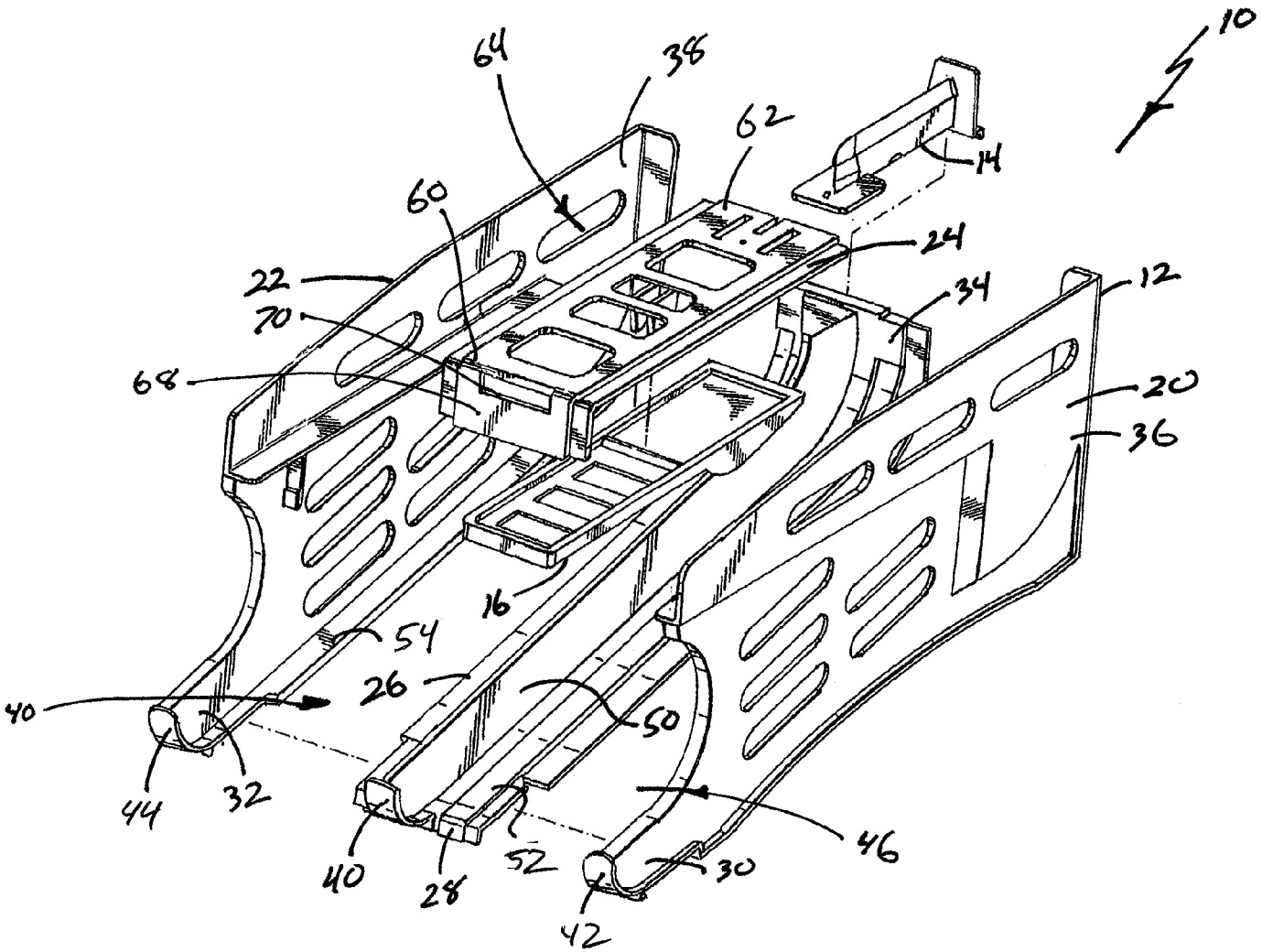
FIG. 1 is an exploded front perspective view of one aspect of the disclosed product dispenser with low product indicator.

Referring to FIG. 1, one aspect of the disclosed product dispenser with low product indicator, generally designated 10, may include a frame 12, an optional cutting element 14 and a flag element 16. As will be described in greater detail below, the frame 12 may support a number of units of product 18 (FIGS. 3 and 4) and the flag element 16 may pivot relative to the frame 12 to provide an indication when a low product condition is present in the frame 12.

The frame 12 may include a first side wall 20, a second side wall 22, an upper support surface 24 and a lower support surface 26. The first side wall 20 may be laterally spaced from the second side wall 22, and may be generally parallel with the second side wall 22.

The lower support surface 26 may extend between the first 20 and second 22 side walls, and may include a front end 28 that extends to the front ends 30, 32 of the side walls 20, 22 and a rear end 34 that extends to the rear ends 36, 38 of the side walls 20, 22. Therefore, the lower support surface 26 and the side walls 20, 22 may define a lower level 40 of the frame 12.

Figure 3:
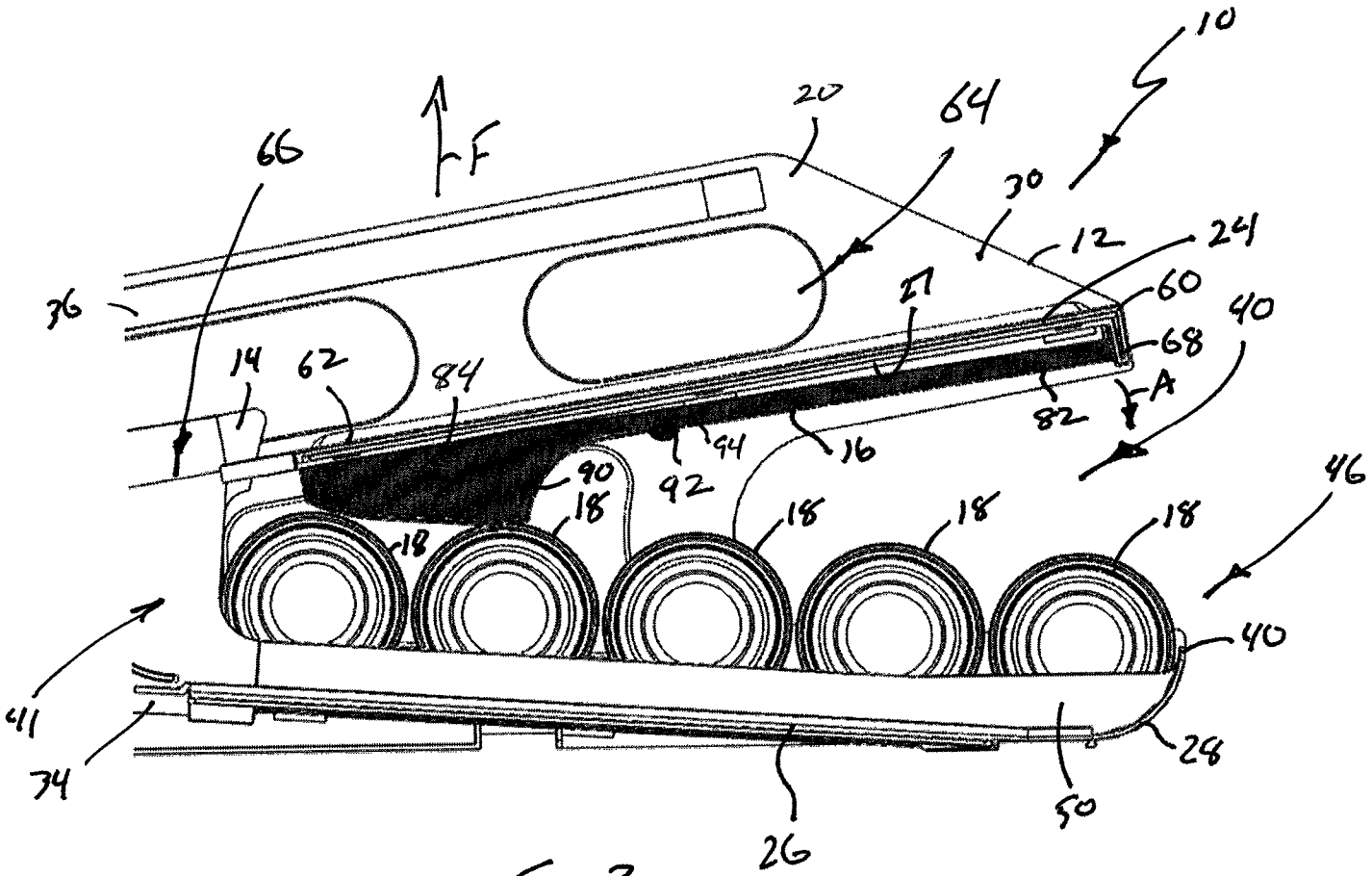
FIG. 3 is a side elevational view of the product dispenser with low product indicator of FIG. 1, shown with the flag element in a first configuration.
Figure 4:
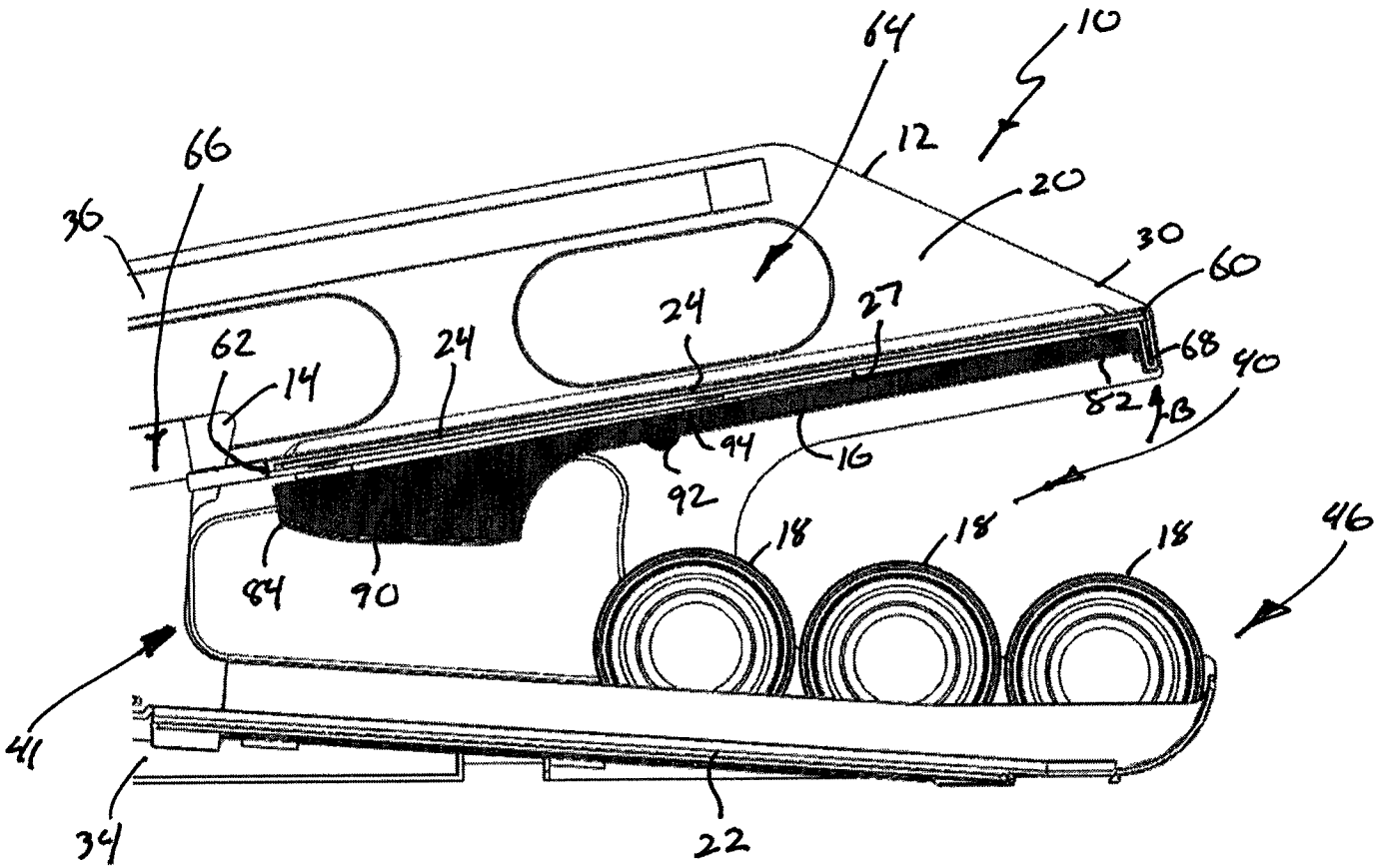
FIG. 4 is a side elevational view of the product dispenser with low product indicator of FIG. 3, shown with the flag element in a second, deployed configuration.

As best shown in FIGS. 3 and 4, the lower support surface 26 may be inclined from the front end 28 to the rear end 34 (i.e., the rear end 34 may be elevated relative to the front end 28) such that product 18 deposited at the rear end 34 of the lower support surface 26 rolls down to the front end 28 of the lower support surface 26 under the force of gravity. The extent of the incline of the lower support surface 26 may be dictated by, among other things, the coefficient of friction of the material used to form the frame 12 and the shape of the products 18 (FIGS. 3 and 4) to be dispensed by the dispenser 10.

Referring back to FIG. 1, one or more stops 40, 42, 44 may be positioned proximate (i.e., at or near) the front end 28 of the lower support surface 26 to prevent product 18 (FIGS. 3 and 4) from rolling beyond the front end 28 of the lower support surface 26. For example, stop 40 may be connected to (e.g., integral with) the lower support surface 26, stop 42 may be connected to (e.g., integral with) the first side wall 20, and stop 44 may be connected to (e.g., integral with) the second side wall 22. Therefore, the stops 40, 42, 44 may collect product 18 at the front end 28 of the lower support surface 26, thereby establishing a product display area 46 at the front end 28 of the lower support surface 26.

In one particular implementation, a divider 50 may extend from the front end 28 of the lower support surface 26 to the rear end 34 of the lower support surface 26 to divide the lower level 40 into a first product channel 52 and a second product channel 54. The first product channel 52 may be defined by the lower support surface 26, the first side wall 20 and the divider 50, and may extend from proximate the rear end 34 of the lower support surface 26 to the front end 28 of the lower support surface 26. The second product channel 54 may be defined by the lower support surface 26, the second side wall 22 and the divider 50, and may extend from proximate the rear end 34 of the lower support surface 26 to the front end 28 of the lower support surface 26. While two product channels 52, 54 are shown and described, those skilled in the art will appreciate that the frame 12 may be constructed to provide only one product channel or more than two product channels, without departing from the scope of the present disclosure.

The upper support surface 24 may extend between the first 20 and second 22 side walls, and may include a front end 60 that extends to the front ends 30, 32 of the side walls 20, 22 and a rear end 62 that extends toward, but not to, the rear ends 36, 38 of the side walls 20, 22, thereby defining an upper level 64 of the frame 12. The spacing between the rear end 62 of the upper support surface 24 and the rear ends 36, 38 of the side walls 20, 22 may define an opening 66 (FIG. 3), which may function as a chute to allow product 18 to move from the upper level 64 to the lower level 40 of the frame 12.

As best shown in FIGS. 3 and 4, the upper support surface 24 may be declined from the front end 60 to the rear end 62 (i.e., the front end 60 may be elevated relative to the rear end 62). Therefore, product 18 supported by the upper support surface 24 may roll under the force of gravity down to the rear end 62 of the upper support surface 24, through the opening 66 and, ultimately, to the lower level 40 of the frame 12.

Referring back to FIG. 1, the front end 60 of the upper support surface 24 may include a face panel 68 connected thereto. The face panel 68 may be integral with the upper support surface 24 or may be connected to the upper support surface 24 using mechanical fasteners, adhesives or the like. The face panel 68 may extend downward (i.e., toward the lower level 40) from the upper support surface 24, and may define an aperture 70 therein. As will be described in greater detail below, the flag element 16 may produce an indication in the aperture 70 when a low product condition is present in the frame 12.

The cutting element 14 may be connected to the frame 12 proximate the rear end 62 of the upper support surface 24. The cutting element 14 may be positioned to form a cut in a container (not shown) when the container is loaded onto the upper support surface 24. The cut formed in the container by the cutting element 14 may produce an opening through which product 18 may exit the container and roll from the upper level 64 of the frame 12 to the lower level 40 and, ultimately, to the product display area 46.

Figure 2:
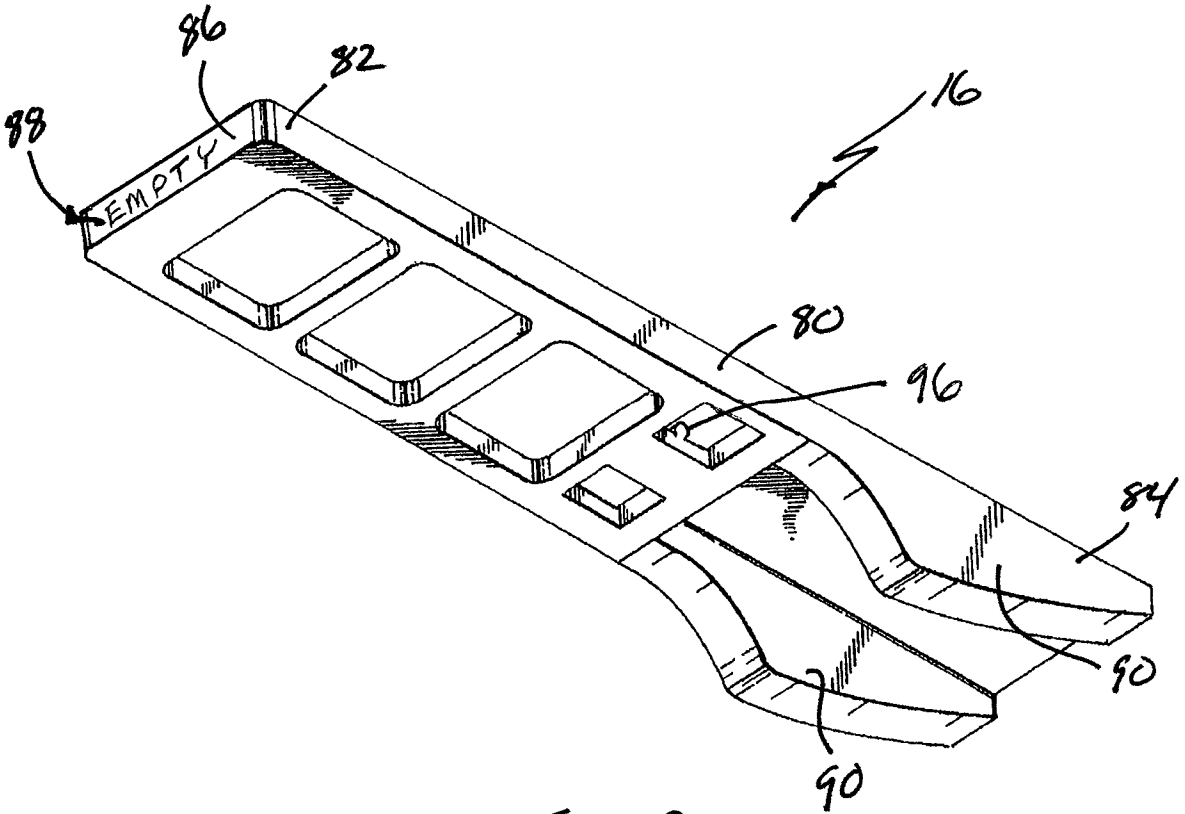
FIG. 2 is a front perspective view of the flag element of the product dispenser with low product indicator of FIG. 1.

As shown in FIG. 2, the flag element 16 may include an elongated body 80 having a front end 82 and a rear end 84. The front end 82 of the flag element 16 may be longitudinally spaced from the rear end 84 by a sufficient distance such that, when connected to the frame 12, the front end 82 of the flag element 16 extends to proximate the front end 60 of the upper support surface 24 and the rear end 84 of the flag element 16 extends to proximate the rear end 2 of the upper support surface 24

The front end 82 of the flag element 16 may include a face 86, which may optionally be marked with indicia 88. As one example, the face 86 of the flag element 16 may be marked with text, such as "LOW" or "EMPTY", to indicate that the dispenser 10 is in a low product condition. As another example, the face 86 of the flag element 16 may be marked with graphics that indicate that the dispenser 10 is in a low product condition. In yet another example, the face 86 of the flag element 16 may be colored (e.g., red) to indicate that the dispenser 10 is in a low product condition.

In one optional implementation, the surface area of the face 86 of the flag element 16 may be greater than the area of the aperture 70 of the face panel 68 of the frame 12 such that the face 86 of the flag element 16 fills the aperture 70 when the dispenser 10 is in a low product condition.

The rear end 84 of the flag element 16 may include one or more protrusions 90 extending downward (i.e., toward the lower level 40) therefrom. Two protrusions 90 are shown in FIG. 2 to correspond with the two product channels 52, 54 of the lower support surface 26. The protrusions 90 may be sufficiently large to engage product 18 (FIG. 3) positioned in the product channels 52, 54, and to provide the rear end 84 of the flag element 16 with sufficient weight (i.e., a greater weight than the front end 82 of the flag element 16) to achieve the desired counterbalancing of the rear end 84 when the flag element 16 is connected to the frame 12, as is discussed in greater detail below.

Referring to FIGS. 3 and 4, the flag element 16 may be pivotally connected to the frame 12 at a pivot point 92. In one specific construction, the flag element 16 may be pivotally connected to the underside 27 of the upper support structure 24 at a pivot point 92 by engaging a fulcrum 94 connected to the underside 27 of the upper support structure 24 with a rounded protrusion 96 extending from the flag element 16. As an example, the engagement between the fulcrum 94 and the rounded protrusion 96 may be a ball-and-socket-type engagement that facilitates pivoting of the flag element 16 about the pivot point 92 through a plane that is generally parallel with a plane defined by one of the side walls 20, 22.

The flag element 16 may be connected to the frame 12 such that the front end 82 of the flag element 16 is positioned proximate the face panel 68 and the rear end 84 of the flag element 16 is positioned proximate the rear portion 41 of the lower level 40. As shown in FIG. 3, the protrusions 90 at the rear end 84 of the flag element 16 may be engaged with product 18 positioned in the product channels 52, 54 at the rear portion 41 of the lower level 40. Therefore, the products 18 engaged with the protrusions 90 may apply an upward force (arrow F) to the rear end 84 of the flag element 16, thereby causing the flag element 16 to pivot about the pivot point 92 and urging the front end 82 of the flag element 16 downward (arrow A) and out of alignment with the aperture 70 of the face panel 68.

Figure 5:
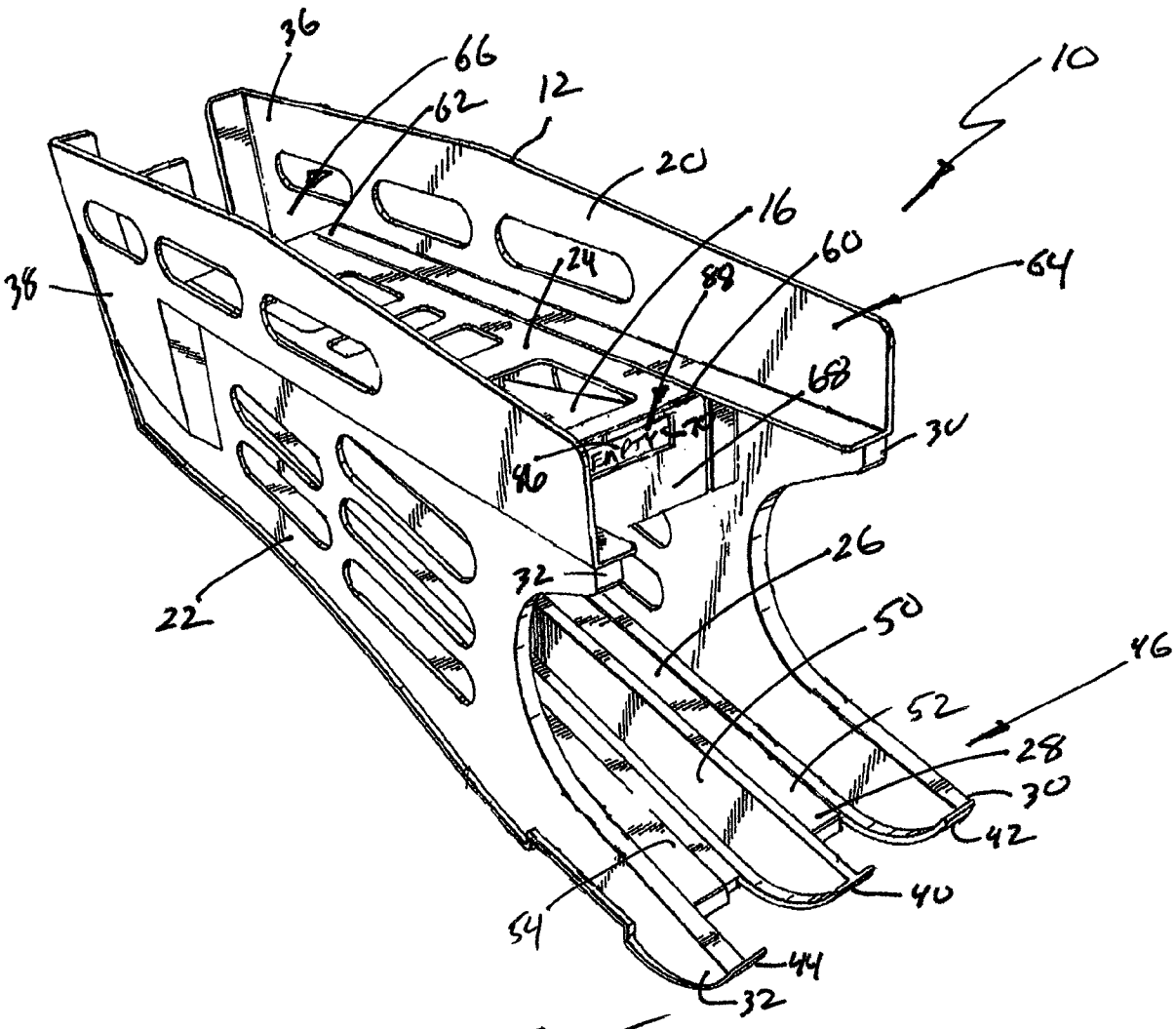
FIG. 5 is a front perspective view of the product dispenser with low product indicator of FIG. 4.

As shown in FIGS. 4 and 5, when no products 18 are positioned below, and engaged with, the protrusions 90 of the flag element 16, the weight and/or balancing of the rear end 84 of the flag element 16 relative to the front end 82 of the flag element 16 may cause the flag element 16 to pivot about pivot point 92 such that the front end 82 of the flag element 16 is urged upward (arrow B) and into alignment with the aperture 70 of the face panel 68. Therefore, with the front end 82 of the flag element 16 aligned with the aperture 70 of the face panel 86, the face 86 of the flag element 16, including indicia 88, may be viewable through the aperture 70, thereby providing a visual indication of the low product condition.

Accordingly, the disclosed product dispenser 10 is configured to provide a visual indication that a low product condition is present. Specifically, the disclosed product dispenser 10 is configured to deploy the flag element 16 when the number of units of product 18 in the lower level 40 of the product dispenser 10 has dropped below a threshold value, thereby signaling a user (e.g., a stock clerk) to load additional product 18.

Although various aspects of the disclosed product dispenser with low product indicator have been shown and described, modifications may occur to those skilled in the art upon reading the specification. The present application includes such modifications and is limited only by the scope of the claims.

What is claimed is:

1. A product dispenser comprising:

a frame configured to support a plurality of products, said frame comprising a front end, a rear end, and a support surface; and a flag element pivotally connected to said support surface, said flag element being moveable relative to said support surface from a first, un-deployed configuration when said flag element is engaged with at least one product of said plurality, to a second, deployed configuration when said flag element is not engaged with said plurality of products.

2. The product dispenser of claim 1 wherein said frame comprises a first side wall laterally spaced from a second side wall, wherein said support surface is positioned between said first and said second side walls.

3. The product dispenser of claim 1 further comprising a container supported on said support surface.

4. The product dispenser of claim 1 wherein said flag element comprises a front end proximate said frame front end and a rear end proximate said frame rear end.

5. The product dispenser of claim 1 wherein said support surface includes a panel connected thereto, said panel defining an aperture therein, and wherein said flag element is aligned with said aperture when said flag element is in said second configuration.

6. The product dispenser of claim 5 wherein said flag element defines a face, and wherein said face is viewable through said aperture when said flag element is in said second configuration.

7. The product dispenser of claim 6 wherein said face is marked with indicia.

8. The product dispenser of claim 1 wherein said flag element is biased to said second configuration.

9. The product dispenser of claim 1 wherein said support surface comprises a first end and a second end, and wherein said second end is elevated relative to said first end.

10. A product dispenser comprising:

a frame comprising:

a first side wall;

a second side wall laterally spaced from said first side wall; and a support surface extending between said first and second side walls, said support surface comprising a front end and a rear end, said front end defining an aperture; and a flag element pivotally connected to said support surface, said flag element comprising a front end proximate said support surface front end and a rear end proximate said support surface rear end, wherein said flag element is moveable from a first configuration, wherein said front end of said flag element is aligned with said aperture, to a second configuration, wherein said front end of said flag element is displaced from said aperture.

11. The product dispenser of claim 10 wherein said flag element is pivotally connected to said support surface.

12. The product dispenser of claim 10 wherein said support surface comprises a face panel connected thereto, and wherein said face panel defines said aperture.

13. The product dispenser of claim 10 wherein said front end of said flag element defines a face, and wherein said face is displayed in said aperture when said flag element is in said first configuration.

14. The product dispenser of claim 13 wherein said face is marked with indicia.

15. The product dispenser of claim 10 wherein said flag element is biased to said first configuration.

16. The product dispenser of claim 10 wherein said rear end of said flag element comprises a protrusion extending therefrom.

17. The product dispenser of claim 10 wherein said rear end of said flag element is engaged with a product supported by said frame when said flag element is in said second configuration.

18. The product dispenser of claim 10 further comprising a container positioned on said support surface.

19. The product dispenser of claim 10 wherein said front end of said support surface is elevated relative to said rear end of said support surface.

20. A product dispenser comprising:

a frame comprising a support surface, said support surface comprising a front end and a longitudinally spaced rear end, said front end of said support surface defining an aperture;

a plurality of products positioned on said support surface, wherein said support surface is configured to urge said plurality of products to said front end of said support surface; and a flag element connected to said frame, said flag element comprising a front end proximate said support surface front end and a rear end proximate said support surface rear end, said flag element front end defining a face, wherein said flag element is moveable relative to said frame between a first configuration and a second configuration, wherein said flag element is in said first configuration when said flag element is engaged with at least one product of said plurality of products and said face is aligned with said aperture, and wherein said flag element is in said second configuration when said flag element is not engaged with said plurality of products and said face is displaced from said aperture.

* * * * *